US009237625B1

(12) United States Patent
Mays, II et al.

(10) Patent No.: US 9,237,625 B1
(45) Date of Patent: Jan. 12, 2016

(54) DRIVER CIRCUIT WITH A COMMON INTERFACE FOR NEGATIVE TEMPERATURE COEFFICIENT RESISTOR AND BI-METALLIC STRIP TEMPERATURE SENSING

(71) Applicant: Universal Lighting Technologies, Inc., Madison, AL (US)

(72) Inventors: Stephen D. Mays, II, Madison, AL (US); John J. Dernovsek, Madison, AL (US); Michael Diaz-Tello, Madison, AL (US); Bobby Srisan, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 226 days.

(21) Appl. No.: 14/133,198

(22) Filed: Dec. 18, 2013

Related U.S. Application Data

(60) Provisional application No. 61/738,866, filed on Dec. 18, 2012.

(51) Int. Cl.

| | |
|---|---|
| ***H01J 7/24*** | (2006.01) |
| ***H01J 13/32*** | (2006.01) |
| ***H01J 17/28*** | (2006.01) |
| ***H01J 19/74*** | (2006.01) |
| ***H01J 61/52*** | (2006.01) |
| ***H05B 33/08*** | (2006.01) |

(52) U.S. Cl.
CPC ..... *H05B 33/089* (2013.01)

(58) Field of Classification Search
USPC ..... 315/117, 118; 313/13
See application file for complete search history.

(56) References Cited

U.S. PATENT DOCUMENTS

| | | | | |
|---|---|---|---|---|
| 6,265,857 | B1 * | 7/2001 | Demsky | G05F 3/245 323/312 |
| 8,884,527 | B2 * | 11/2014 | Lin | H05B 33/086 315/149 |
| 9,137,871 | B2 * | 9/2015 | Bakk | H05B 33/0857 |
| 2003/0001517 | A1 * | 1/2003 | Piaskowski | H05B 41/2856 315/224 |
| 2003/0031037 | A1 * | 2/2003 | Piaskowski | H05B 41/2856 363/125 |
| 2006/0149607 | A1 * | 7/2006 | Sayers | G06Q 50/06 315/291 |
| 2007/0171159 | A1 * | 7/2007 | Lee | H05B 33/0857 345/83 |
| 2011/0006684 | A1 * | 1/2011 | Hodgson | B60Q 3/005 315/77 |
| 2013/0033323 | A1 * | 2/2013 | Scuderi | G01D 1/16 330/257 |
| 2014/0070715 | A1 * | 3/2014 | Gao | H05B 33/0809 315/187 |
| 2015/0022120 | A1 * | 1/2015 | Ko | H05B 33/089 315/307 |
| 2015/0264782 | A1 * | 9/2015 | Miura | H05B 37/0272 315/291 |

* cited by examiner

*Primary Examiner* — Adam Houston
(74) *Attorney, Agent, or Firm* — Patterson Intellectual Property Law, P.C.; Mark J. Patterson

(57) ABSTRACT

A light fixture includes a light source driver circuit and a light engine. The light engine includes a light source and a temperature sensor configured to sense a temperature of the light source. The driver circuit includes a temperatures sensing circuit operable to connect to the temperature sensor and provide a temperature signal indicative of the temperature of the light source. The driver circuit monitors the temperature signal and shuts down an output current provided to the light source when the temperature is outside of a predetermined operating range. The driver circuit is configured to interface with a thermistor or normally bi-metal switch temperature sensor without alteration.

18 Claims, 4 Drawing Sheets

DRIVER CIRCUIT WITH A COMMON INTERFACE FOR NEGATIVE TEMPERATURE COEFFICIENT RESISTOR AND BI-METALLIC STRIP TEMPERATURE SENSING

CROSS-REFERENCES TO RELATED APPLICATIONS

This application claims priority to and hereby incorporates by reference in its entirety U.S. Provisional Patent Application Ser. No. 61/738,866 entitled "LED DRIVER CIRCUIT WITH A COMMON INTERFACE FOR NEGATIVE TEMPERATURE COEFFICIENT RESISTOR AND BI-METALLIC STRIP TEMPERATURE SENSING" filed on Dec. 18, 2012.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to light source driver circuits operable to interface with external temperature sensors. More particularly, this invention pertains to driver circuits supporting both negative temperature coefficient resistor temperature sensing and normally closed bi-metal switch (i.e., bi-metallic strip switch) temperature sensing.

Referring to FIG. 1, a light source (e.g., light emitting diode) driver circuit 100 is configured with an internal negative temperature coefficient (NTC) sensing circuit 102. The internal NTC sensing circuit 102 interfaces with an NTC resistor 104 embedded in a light engine 106. The light engine 106 includes a light source 108 that may be formed from a plurality of LEDs configured in various parallel and series arrangements. The driver circuit 100 includes a constant current source 110 to provide power to the light engine 106 from a power source (not shown). The constant current source 110 may include a controller and a current source tank circuit. The controller is responsive to a temperature signal from the internal NTC sensing circuit 102 to adjust operation and current output of the current source tank circuit. In other words, the constant current source 110 is responsive to the temperature signal from the NTC sensing circuit 102 to adjust a current provided to the light engine 106.

Referring to FIG. 2, a light source (e.g., light emitting diode) driver circuit 200 is configured with an internal bi-metallic strip switch sensing circuit 202. The internal bi-metallic strip switch sensing circuit 202 interfaces with a bi-metallic strip switch 204 embedded in the light engine 206. The light engine 206 includes a light source 108 that may be formed of a plurality of LEDs configured in various parallel and series arrangements. The driver circuit 200 includes a constant current source 110 to provide power to the light engine 206 from a power source (not shown). The constant current source 110 may include a controller and a current source tank circuit. The controller is responsive to a temperature signal from the internal bi-metallic strip switch sensing circuit 202 to adjust operation and current output of the current source tank circuit. In other words, the constant current source 110 is responsive to the temperature signal from the internal bi-metallic strip switch sensing circuit 202 to adjust a current provided to the light engine 206.

Conventional driver circuits are designed to interface with either an NTC resistor as in FIG. 1, or a bi-metallic strip switch as in FIG. 2, but not both. For example, the bi-metal switch may be configured as an interrupter to interrupt power to the light source, whereas the thermistor is configured as a sensor to be monitored and current adjusted as a temperature indicated by the thermistor approaches a predetermined limit.

BRIEF SUMMARY OF THE INVENTION

Aspects of the present invention provide a light source driver circuit operable to interface with external temperature sensors. More particularly, this invention pertains to constant current driver circuits configured to interface with negative temperature coefficient thermistors, positive temperature coefficient thermistors, and normally closed bi-metallic strip temperature sensors.

In one aspect, a constant current driver circuit includes a current source tank circuit, a temperature sensing circuit, and a controller. The current source tank circuit is configured to receive power from a power source and provide an output current to a light source of a light engine as a function of a control signal. The temperature sensing circuit connects to a temperature sensor of the light engine. The temperature sensor is either a thermistor or a bi-metal switch. The temperature sensing circuit further provides a temperature signal indicative of a resistance of the temperature sensor to the controller. The controller is connected to the current source tank circuit, the temperature sensing circuit, and a ground. The controller provides the control signal to the current source tank circuit. The controller further receives the temperature signal from the temperature sensing circuit at a temperature signal input of the controller and adjusts the provided control signal as a function of the received temperature signal.

In another aspect, a light fixture includes a light engine and a constant current driver circuit. The light engine includes a light source and a temperature sensor. The light source provides light in response to receiving power. The temperature sensor is configured to sense temperature of the light source. A resistance of the temperature sensor varies as a function of the sense temperature of the light source. The temperature sensor is either a thermistor or a bi-metal switch. The constant current driver circuit connects to the light source. The constant current driver circuit includes a current source tank circuit configured to receive power from a power source and provide an output current to the light source of the light engine as a function of a control signal. The temperature sensing circuit connects to the temperature sensor of the light engine and provides a temperature signal indicative of a resistance of the temperature sensor to the controller. The controller is connected to the current source tank circuit, the temperature sensing circuit, and a ground. The controller provides the control signal the current source tank circuit. The controller further receives the temperature signal from the temperature sensing circuit at a temperature signal input of the controller and adjusts the provided control signal as a function of the received temperature signal.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified.

As used herein, "ballast" and "driver circuit" refer to any circuit for providing power (e.g., current) from a power source to a light source. Additionally, "light source" refers to one or more light emitting devices such as fluorescent lamps, high intensity discharge lamps, incandescent bulbs, and solid state light-emitting elements such as light emitting diodes (LEDs), organic light emitting diodes (OLEDs), and plasmaloids. Further, "connected between" or "connected to" means electrically connected when referring to electrical devices in circuit schematics or diagrams.

Figure 1:
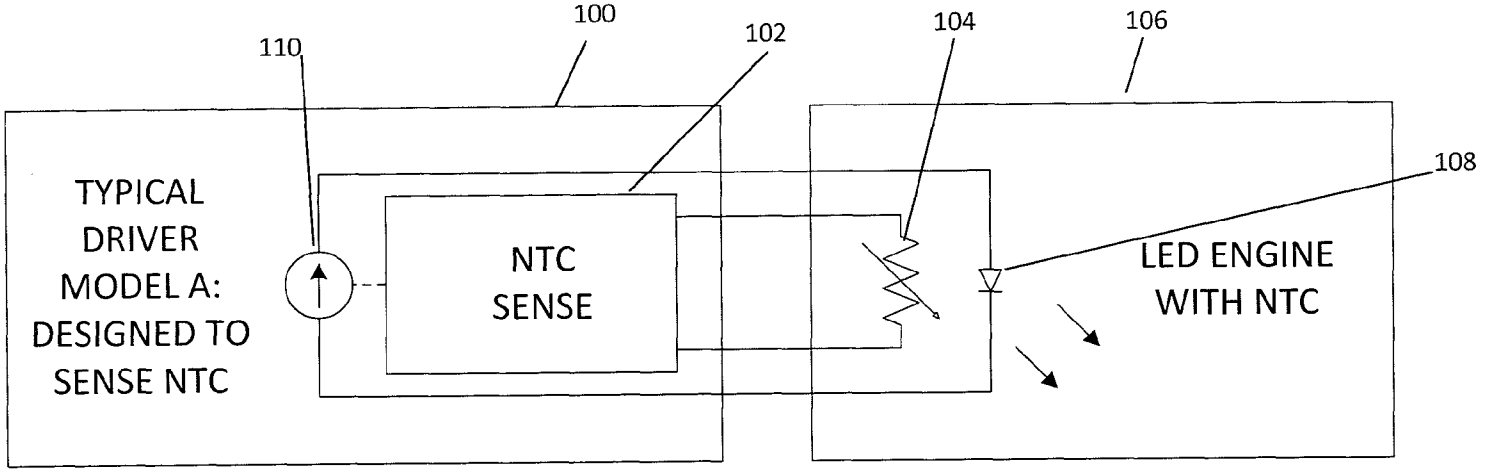
FIG. 1 PRIOR ART
FIG. 1 is a block diagram and partial schematic of a constant current driver circuit and light engine including a thermistor.
Figure 2:
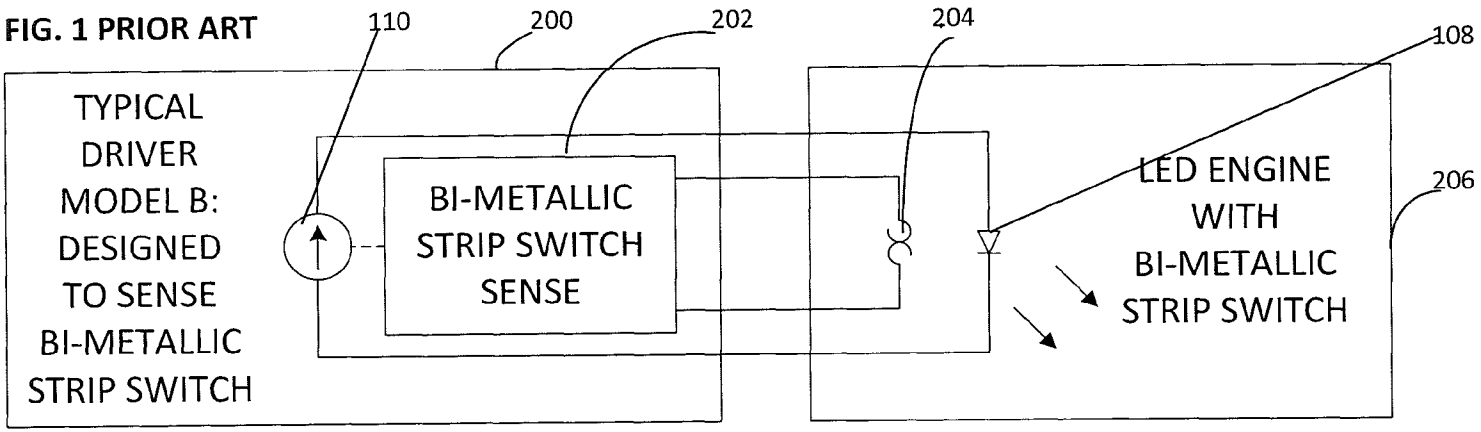
FIG. 2 PRIOR ART
FIG. 2 is a block diagram and partial schematic of a constant current driver circuit and light engine including a bi-metal switch.
Figure 3:
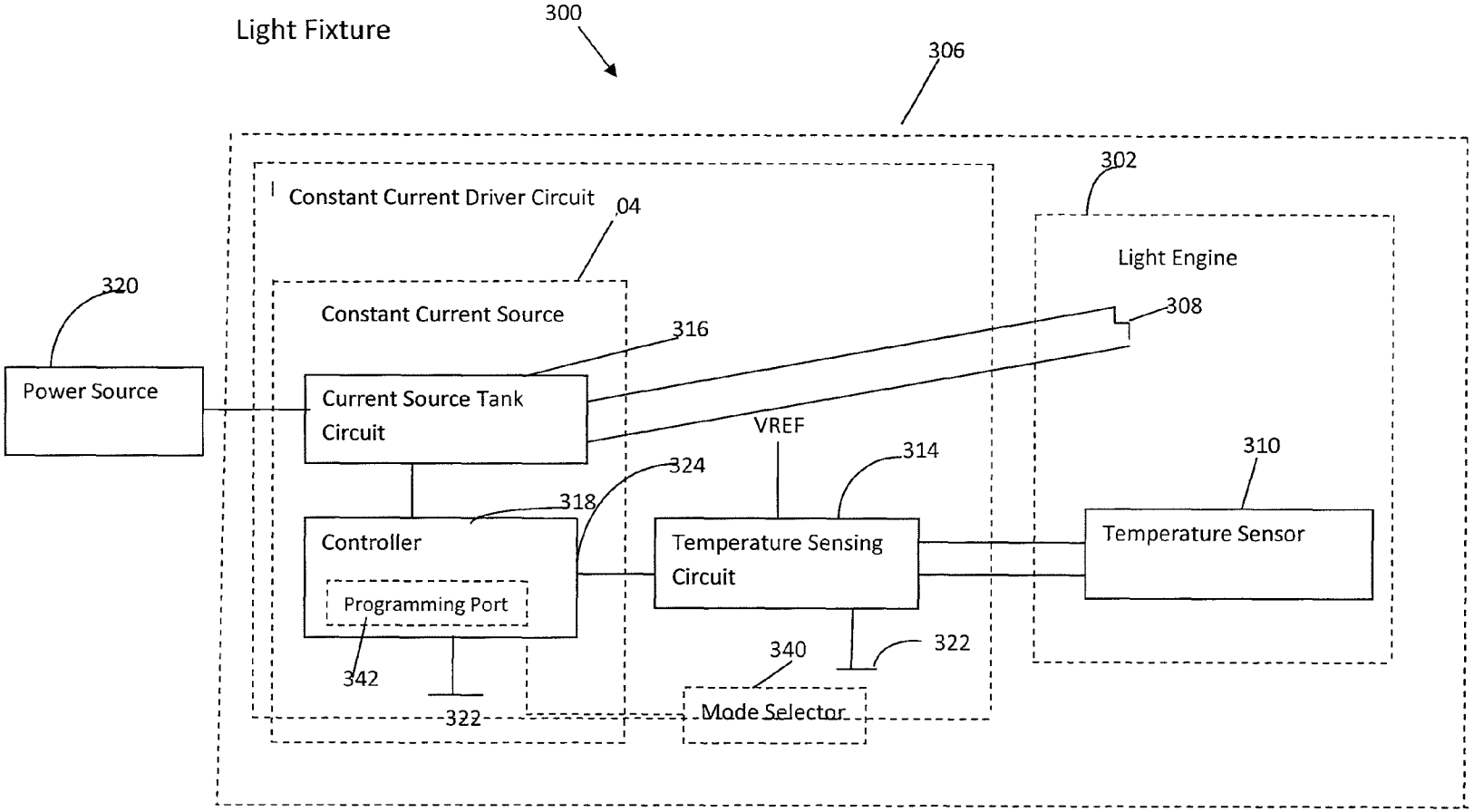
FIG. 3 is a block diagram and partial schematic of light fixture including a constant current driver circuit and a light engine including a temperature sensor.

Referring to FIG. 3, a light fixture 300 includes a light engine 302 and a constant current driver circuit 304. Optionally, the light fixture 300 includes a housing 306 operable to support the constant current driver circuit 304 and the light engine 302. The housing 306 may include features such as a light diffuser or lens. Optionally, light diffusers and/or lenses may be included in the light engine 302.

The light engine 302 includes a light source 308 and a temperature sensor 310. The light source 308 provides light in response to receiving power. The temperature sensor 310 is configured to sense temperature of the light source 308. The resistance of the temperature sensor 310 varies as a function of the sensed temperature of the light source 308. Temperature sensor 310 is one of a thermistor or a bi-metal switch located in close proximity to the light source 308. In one embodiment, a thermistor and bi-metal switch may be interchanged without affecting operational configuration of the temperature sensing circuit 314. In another embodiment, the thermistor and bi-metal switch may be interchanged without affecting operational configuration of the controller 318. This is possible, for example, when the bi-metal switch is a normally closed bi-metal switch and the thermistor is a positive temperature coefficient thermistor.

The constant current driver circuit 304 connects to the light engine 302. The constant current driver circuit 304 includes a constant current source 312 and a temperature sensing circuit 314. The constant current source 312 includes a current source tank circuit 316 and the controller 318. The current source tank circuit 316 is configured to receive power from a power source 320 and provide an output current to the light source 308 of the light engine 302 is a function of a control signal provided by the controller 318.

The temperature sensing circuit 314 connects to the temperature sensor 310 of the light engine 302. The temperature sensing circuit 314 provides a temperature signal indicative of a resistance of the temperature sensor 310 to the controller 318. In one embodiment, the temperature signal is a voltage proportional to a resistance of the temperature sensor 310.

Figure 4:
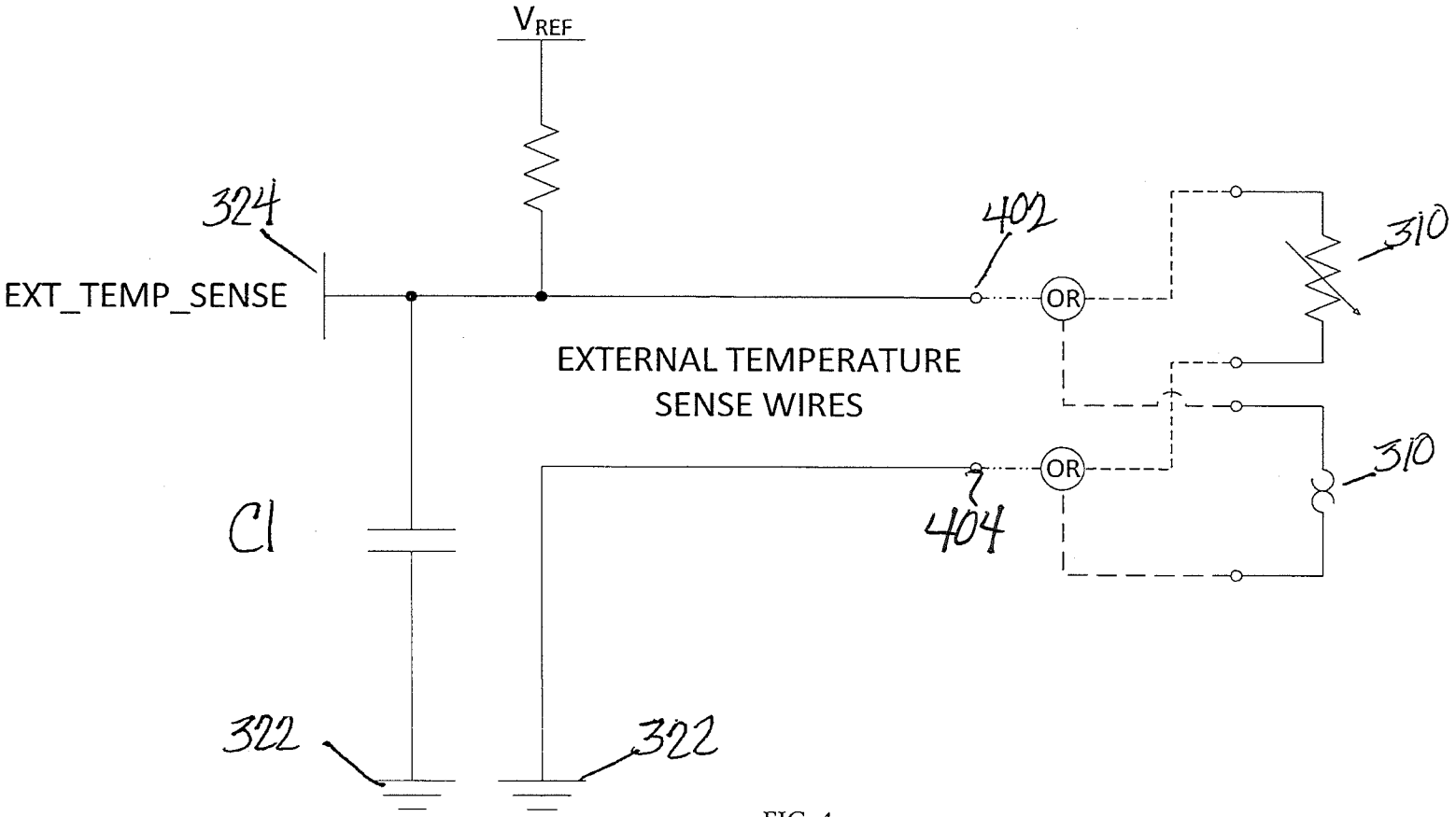
FIG. 4 is a schematic of one embodiment of a temperature sensing circuit of the driver circuit of FIG. 3.

Referring to FIG. 4, in one embodiment of the temperature sensing circuit 314, the temperature sensing circuit 314 includes a first lead 402, a second lead 404, a resistor R1, and capacitor C1. The first lead 402 is connected to a reference voltage $V_{REF}$ of the driver circuit 304. The reference voltage $V_{REF}$ of the driver circuit 304 may be, for example, a bias voltage of the controller 318 or some other internally generated bias or reference voltage of the driver circuit 304. The second lead 404 is connected to the temperature signal input 324 of the controller 318. The resistor R1 is connected between the second lead 404 and the ground 322. The capacitor C1 is connected in parallel with the resistor R1. The temperature sensor 308 is coupled between the first lead 402 and the second lead 404. That is, the first lead 402 may be connected to the second lead 404 via the temperature sensor 310.

Figure 5:
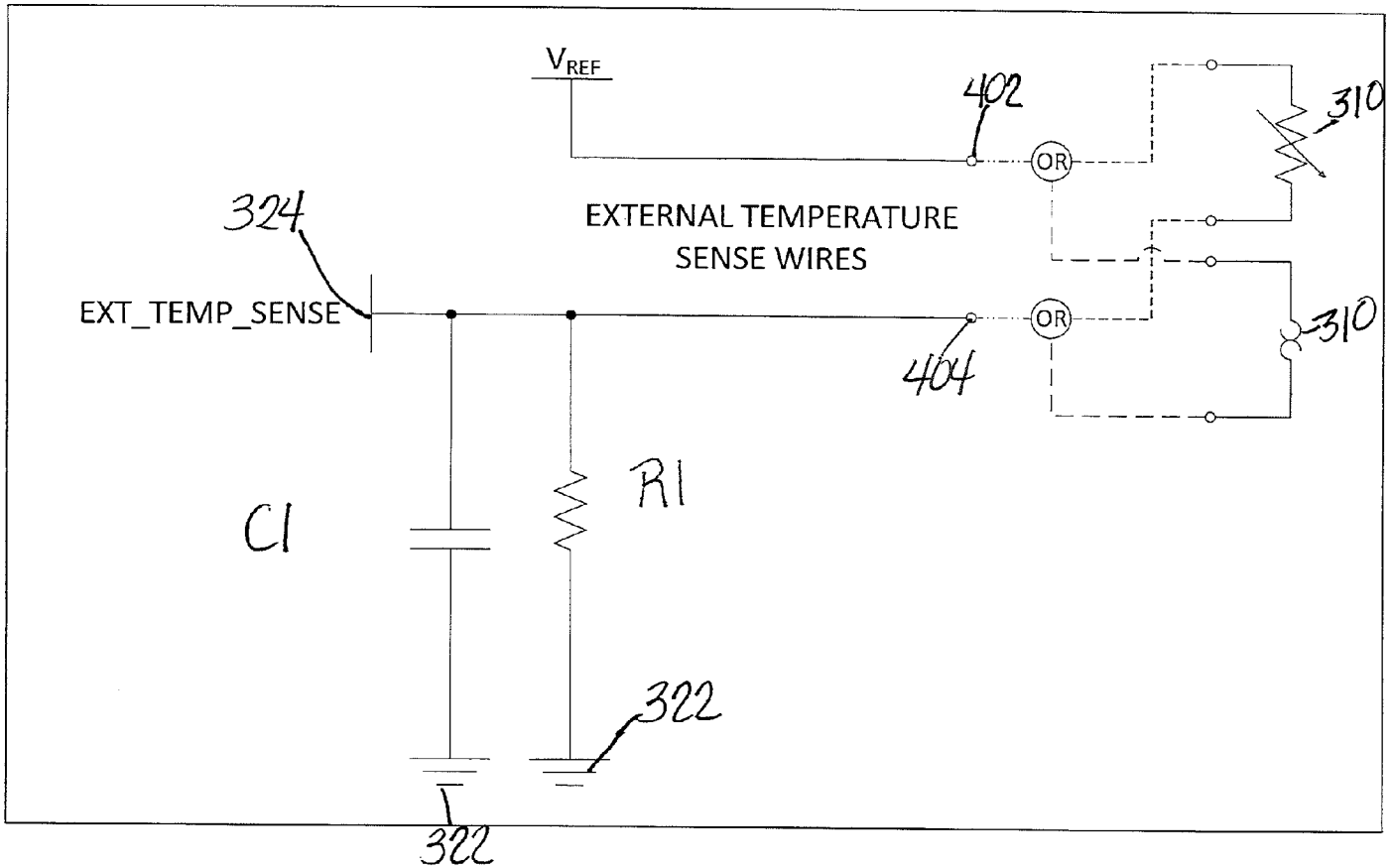
FIG. 5 is a schematic of another embodiment of a temperature sensing circuit of the driver circuit of FIG. 3.

Referring to FIG. 5, in another embodiment of the temperature sensing circuit 314, the first lead 402 is connected to the temperature signal input of the controller 324. A second lead 404 is connected to ground 322. The resistor R1 is connected between the reference voltage $V_{REF}$ of the driver circuit 304 and the first lead 402. The capacitor C1 is connected between the first lead 402 and the ground 322. The temperature sensor 308 is coupled between the first lead 402 and the second lead 404. That is, the first lead 402 may be connected to the second lead 404 via the temperature sensor 310.

Referring again to FIG. 3, the controller 318 is connected to the current source tank circuit 316, the temperature sensing circuit 314, and a ground 322. The controller 318 provides the control signal to current source tank circuit 316. The controller 318 further receives the temperature signal from the temperature sensing circuit 314 at a temperature signal input 324 of the controller 318 and adjusts the provided control signal as a function of the received temperature signal.

In one embodiment, the temperature sensor 310 is interchangeable between a positive temperature coefficient resistor (i.e., a thermistor) and a bi-metal switch that is normally closed. The thermistor 310 is a positive temperature coefficient resistor having a resistance that increases as the temperature of the light source 308 increases. The bi-metal switch is a normally closed switch having a resistance of approximately zero ohms when a temperature of the light source 308 is within a predetermined operating temperature range, and an open circuit resistance (i.e., a resistance of a quantity of air or other substantially nonconductive material) when the temperature of the light source is above the predetermined operating temperature range. The controller 318 adjusts the provided control signal as a function of the received temperature signal by increasing the frequency or reducing the duty cycle of the control signal to cease the output current from the current source tank circuit when the received temperature signal exceeds a second predetermined limit. That is, the controller 318 shuts down the current source tank circuit 316 when the controller 318 determines that the light source 308 exceeded a safe operating temperature.

In another embodiment, the temperature sensor 310 is interchangeable between a negative temperature coefficient resistor (i.e., thermistor) and a normally open bi-metal switch. The negative temperature coefficient resistor has a resistance that decreases as the temperature of the light source 308 increases. The bi-metal switch is a normally open switch having an open circuit resistance when the temperature of the light source 308 is within the predetermined operating temperature range and a resistance of approximately zero ohms when the temperature of the light source 308 is above the predetermined operating range. The controller 318 adjusts the provided control signal as a function of the received temperature signal by increasing a frequency or reducing a duty cycle of the control signal when the received temperature signal falls below a first predetermined limit.

In one embodiment, the controller 318 has a first mode of operation and a second mode of operation. In the first mode of operation, the controller 318 adjusts the provided control signal as a function of the received temperature signal by increasing the frequency or reducing the duty cycle of the control signal to cease the output current from the current source tank circuit when the received temperature signal exceeds a second predetermined limit. In the second mode, the controller 318 adjusts the provided control signal as a function of the received temperature signal by increasing a frequency or reducing a duty cycle of the control signal when the received temperature signal falls below a first predetermined limit.

In one embodiment, the constant current driver circuit 304 further includes a mode selector 340 that receives an input from a user selecting the first mode of operation or the second mode of operation and provides the selected mode of operation to the controller 318. The controller 318 receives the selected mode of operation from the mode selector 340 and operates in the selected mode of operation (i.e., the first mode of operation with the second mode of operation). In one embodiment, the mode selector 340 is a single bit, two-position DIP switch. In another embodiment, the controller 318 includes a programming port 342. The programming port 342 is configured to receive computer executable instructions for performing a method of adjusting the control signal. The method corresponds to or is representative of one of the first mode of operation or the second mode of operation. In one embodiment, the programming port 342 is a jumper pin interface to receive data in a serial arrangement (e.g., RS232).

Because the predetermined operating temperature range and corresponding resistance of the temperature sensor 310 is known, the resistor R1 may be selected such that the first predetermined limit and second predetermined limit correspond to voltages between a voltage of the ground 322 and the reference voltage $V_{REF}$. This ensures proper operation of the thermal protection provided by the temperature sensor 310, temperature sensing circuit 314, and controller 318.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media. As used herein, server is not intended to refer to a single computer or computing device. In implementation, a server will generally include an edge server, a plurality of data servers, a storage database (e.g., a large scale RAID array), and various networking components. It is contemplated that these devices or functions may also be implemented in virtual machines and spread across multiple physical computing devices.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful DRIVER CIRCUIT WITH A COMMON INTERFACE FOR NEGATIVE TEMPERATURE COEFFICIENT RESISTOR AND BI-METALLIC STRIP TEMPERATURE SENSING it is not intended that such references be construed as limitations upon the scope of this invention except as set forth in the following claims.

What is claimed is:

1. A constant current driver circuit comprising:

a current source tank circuit configured to receive power from a power source and provide an output current to a light source of a light engine as a function of a control signal;

a temperature sensing circuit operable to connect to a temperature sensor of the light engine, wherein the temperature sensor is one of a thermistor or a bi-metal switch, and provide a temperature signal indicative of a resistance of the temperature sensor; and a controller connected to the current source tank circuit, the temperature sensing circuit, and a ground, wherein the controller is operable to provide the control signal to the current source tank circuit, receive the temperature signal from the temperature sensing circuit at a temperature signal input of the controller, and adjust the provided control signal as a function of the received temperature signal.

2. The constant current driver circuit of claim 1, wherein the thermistor and the bi-metal switch are configured to be interchanged without affecting operation or configuration of the temperature sensing circuit and without affecting operation or configuration of the controller.

3. The constant current driver circuit of claim 1, wherein the temperature sensor is configured to sense a temperature of the light source of the light engine.

4. The constant current driver circuit of claim 1, wherein the temperature sensing circuit comprises:

a first lead connected to a reference voltage of the driver circuit;

a second lead connected to the temperature signal input of the controller;

a resistor connecting the second lead to the ground; and a capacitor connected in parallel with the resistor, and wherein the first lead and the second leader operable to connect to the temperature sensor.

5. The constant current driver circuit of claim 1, wherein the temperature sensing circuit comprises:

a first lead connected to the temperature signal input of the controller;

a second lead connected to the ground;

a resistor connected between a reference voltage and the first lead;

a capacitor connected between the first lead and the ground; and the first lead and the second lead are configured to connect to the temperature sensor.

6. The constant current driver circuit of claim 1, wherein:

the thermistor comprises a positive temperature coefficient resistor having a resistance that increases as the temperature of the light source increases;

the bi-metal switch is a normally closed switch having a resistance of approximately zero ohms when a temperature of the light source is within a predetermined operating temperature range, and an open circuit resistance when the temperature of the light source is above the predetermined operating temperature range; and the controller adjusts the provided control signal as a function of the received temperature signal by increasing the frequency or reducing the duty cycle of the control signal to cease the output current from the current source tank circuit when the received temperature signal exceeds a second predetermined limit.

7. The constant current driver circuit of claim 1, wherein:

the thermistor comprises is a negative temperature coefficient resistor that has a resistance that decreases as the temperature of the light source increases;

the controller is configured to adjust the provided control signal as a function of the received temperature signal by increasing a frequency or reducing a duty cycle of the control signal when the received temperature signal falls below a first predetermined limit.

8. The constant current driver circuit of claim 1, wherein:

the controller has a first mode of operation and a second mode of operation, wherein in the first mode, the controller adjusts the provided control signal as a function of the received temperature signal by increasing the frequency or reducing the duty cycle of the control signal to cease the output current from the current source tank circuit when the received temperature signal exceeds a second predetermined limit, and in the second mode, the controller adjusts the provided control signal as a function of the received temperature signal by increasing a frequency or reducing a duty cycle of the control signal when the received temperature signal falls below a first predetermined limit;

the constant current driver circuit further comprises a mode selector operable to receive input from a user selecting the first mode of operation or the second mode of operation and provide the selected mode of operation to the controller; and the controller is configured to receive the selected mode of operation from the mode selector and operate in the selected mode of operation.

9. The constant current driver circuit of claim 1, wherein:

the controller comprises a programming port, wherein the programming port is configured to receive computer executable instructions for performing a method of adjusting the control signal, wherein the method is representative of a first mode of operation or a second mode of operation, wherein in the first mode, the controller adjusts the provided control signal as a function of the received temperature signal by increasing the frequency or reducing the duty cycle of the control signal to cease the output current from the current source tank circuit when the received temperature signal exceeds a second predetermined limit, and in the second mode, the controller adjusts the provided control signal as a function of the received temperature signal by increasing a frequency or reducing a duty cycle of the control signal when the received temperature signal falls below a first predetermined limit.

10. A light fixture comprising:

a light engine comprising a light source operable to provide light in response to receiving power;

a temperature sensor configured to sense a temperature of the light source, wherein a resistance of the temperature sensor varies as a function of the sensed temperature of the light source, wherein the temperature sensor is one of a thermistor or a bi-metal switch, and a constant current driver circuit operable to connect to the light engine, said constant current driver circuit comprising a current source tank circuit configured to receive power from a power source and provide an output current to the light source of the light engine as a function of a control signal, a temperature sensing circuit operable to connect to the temperature sensor of the light engine, and provide a temperature signal indicative of a resistance of the temperature sensor;

a controller connected to the current source tank circuit, the temperature sensing circuit, and a ground, wherein the controller is operable to provide the control signal to the current source tank circuit, receive the temperature signal from the temperature sensing circuit at a temperature signal input of the controller, and adjust the provided control signal as a function of the received temperature signal.

11. The light fixture of claim 10, wherein the thermistor and the bi-metal switch are configured to be interchanged without affecting operation or configuration of the temperature sensing circuit and without affecting operation or configuration of the controller.

12. The light fixture of claim 10, wherein the temperature sensing circuit comprises:

a first lead connected to a reference voltage of the driver circuit;

a second lead connected to the temperature signal input of the controller;

a resistor connecting the second lead to the ground;

a capacitor connected in parallel with the resistor; and the first lead and the second lead are configured to connect to the temperature sensor.

13. The light fixture of claim 10, wherein the temperature sensing circuit comprises:

a first lead connected to the temperature signal input of the controller;

a second lead connected to the ground;

a resistor connected between a reference voltage and the first lead;

a capacitor connected between the first lead and the ground; and the first lead and the second lead are configured to connect to the temperature sensor.

14. The light fixture of claim 10, wherein:

the thermistor comprises a positive temperature coefficient resistor having a resistance that increases as the temperature of the light source increases;

the bi-metal switch comprises a normally closed switch having a resistance of approximately zero ohms when a temperature of the light source is within a predetermined operating temperature range, and an open circuit resistance when the temperature of the light source is above the predetermined operating temperature range; and the controller is configured to adjust the provided control signal as a function of the received temperature signal by increasing the frequency or reducing the duty cycle of the control signal to cease the output current from the current source tank circuit when the received temperature signal exceeds a second predetermined limit.

15. The light fixture of claim 10, wherein:

the thermistor comprises a negative temperature coefficient resistor that has a resistance that decreases as the temperature of the light source increases; and the controller is configured to adjust the provided control signal as a function of the received temperature signal by increasing a frequency or reducing a duty cycle of the control signal when the received temperature signal falls below a first predetermined limit.

16. The light fixture of claim 10, wherein:

the controller has a first mode of operation and a second mode of operation, wherein:

in the first mode, the controller adjusts the provided control signal as a function of the received temperature signal by increasing the frequency or reducing the duty cycle of the control signal to cease the output current from the current source tank circuit when the received temperature signal exceeds a second predetermined limit; and in the second mode, the controller adjusts the provided control signal as a function of the received temperature signal by increasing a frequency or reducing a duty cycle of the control signal when the received temperature signal falls below a first predetermined limit;

the constant current driver circuit further comprises a mode selector operable to receive input from a user selecting the first mode of operation or the second mode of operation and provide the selected mode of operation to the controller; and the controller is operable to receive the selected mode of operation from the mode selector and operate in the selected mode of operation.

17. The light fixture of claim 10, wherein:

the controller comprises a programming port, wherein the programming port is operable to receive computer executable instructions for performing a method of adjusting the control signal, wherein the method is representative of a first mode of operation or a second mode of operation, wherein in the first mode, the controller adjusts the provided control signal as a function of the received temperature signal by increasing the frequency or reducing the duty cycle of the control signal to cease the output current from the current source tank circuit when the received temperature signal exceeds a second predetermined limit, and in the second mode, the controller adjusts the provided control signal as a function of the received temperature signal by increasing a frequency or reducing a duty cycle of the control signal when the received temperature signal falls below a first predetermined limit.

18. The light fixture of claim 10, further comprising a housing configured to support the light engine and the constant current driver circuit.

* * * * *